US011450497B2

(12) United States Patent
Ono et al.

(10) Patent No.: US 11,450,497 B2
(45) Date of Patent: Sep. 20, 2022

(54) ELECTROMAGNETIC SWITCH DEVICE FOR STARTER

(71) Applicant: Mitsubishi Electric Corporation, Tokyo (JP)

(72) Inventors: Takuma Ono, Tokyo (JP); Mitsuyasu Okamoto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 55 days.

(21) Appl. No.: 16/754,410

(22) PCT Filed: Nov. 21, 2017

(86) PCT No.: PCT/JP2017/041777
§ 371 (c)(1),
(2) Date: Apr. 8, 2020

(87) PCT Pub. No.: WO2019/102518
PCT Pub. Date: May 31, 2019

(65) Prior Publication Data

US 2020/0312596 A1 Oct. 1, 2020

(51) Int. Cl.
*H01H 50/44* (2006.01)
*F02N 11/08* (2006.01)

(52) U.S. Cl.
CPC ..... *H01H 50/44* (2013.01); *F02N 11/087* (2013.01); *H01H 50/443* (2013.01); *F02N 2011/0874* (2013.01); *H01H 2050/446* (2013.01)

(58) Field of Classification Search
CPC . H01H 50/44; H01H 50/443; H01H 2050/446
(Continued)

(56) References Cited

U.S. PATENT DOCUMENTS 1,525,420 A * 2/1925 Varley ..... B60Q 1/52 340/455
3,566,322 A * 2/1971 Horbach ..... H01F 5/04 336/192

(Continued)

FOREIGN PATENT DOCUMENTS

CN 1194054 A 9/1998
JP 2001-035336 A 2/2001
JP 2002-313205 A 10/2002

OTHER PUBLICATIONS

Japanese Office Action dated May 11, 2021 in Patent Application No. 2019-555097.

(Continued)

*Primary Examiner* — Alexander Talpalatski
(74) *Attorney, Agent, or Firm* — Sughrue Mion, PLLC; Richard C. Turner

(57) ABSTRACT

Provide an electromagnetic switch device for a starter, by which a winding fluctuation of a plurality of coils, of which wire diameters are different from each other, is prevented, which can be downsized and can be produced with a low cost. A bobbin, at which winding portions are separated by using a first flange portion which includes a first notch portion, second notch portions, and third notch portions, by which coils are led out, and a first separation wall and a second separation wall, which include the second notch portions and the third notch portions, by which coils are led out, is included, and a main aspiration holding coil, a sub-aspiration holding coil, and a resistance coil, of which wire diameters are different from each other, which are respectively wound around a first winding portion, a second winding portion, and a third winding portion, which are separated, are provided.

8 Claims, 4 Drawing Sheets

(58) Field of Classification Search
USPC ..... 335/126, 178, 131
See application file for complete search history.

(56) References Cited

U.S. PATENT DOCUMENTS

| | | | | | |
|---|---|---|---|---|---|
| 3,895,333 | A * | 7/1975 | Cressman | H01F 5/02 | 335/297 |
| 4,238,753 | A * | 12/1980 | Bayer | H01F 5/04 | 336/178 |
| RE34,870 | E * | 3/1995 | Cummins | H01F 7/13 | 310/12.01 |
| 5,757,256 | A * | 5/1998 | Vilou | H01H 51/065 | 335/126 |
| 5,774,036 | A | 6/1998 | Hrytzak et al. | | |
| 6,983,923 | B2 * | 1/2006 | Fukui | A61B 5/0235 | 251/65 |
| 7,545,248 | B2 * | 6/2009 | Imanishi | H01H 50/023 | 335/131 |
| 7,570,138 | B2 * | 8/2009 | Hirabayashi | F02N 11/00 | 307/10.6 |
| 7,982,565 | B2 * | 7/2011 | Bradfield | F02N 15/067 | 335/184 |
| 8,237,524 | B2 * | 8/2012 | Niimi | F02N 15/067 | 335/177 |
| 8,416,039 | B2 * | 4/2013 | Bradfield | H01F 7/127 | 335/126 |
| 8,477,001 | B2 * | 7/2013 | Bradfield | H01H 50/12 | 335/268 |
| 8,525,625 | B2 * | 9/2013 | Bradfield | F02N 11/087 | 335/256 |
| 8,570,137 | B2 * | 10/2013 | Pan | H01F 27/2847 | 336/198 |
| 8,648,686 | B2 * | 2/2014 | Tsai | H01F 27/324 | 336/198 |
| 8,754,556 | B2 * | 6/2014 | Haruno | F02N 15/067 | 310/71 |
| 9,595,411 | B2 * | 3/2017 | Shimizu | H01H 50/16 | |
| 2002/0145494 | A1 | 10/2002 | Andoh et al. | | |
| 2004/0169573 | A1 | 9/2004 | Andoh et al. | | |
| 2012/0068475 | A1 * | 3/2012 | Bradfield | F02N 11/087 | 290/38 R |

OTHER PUBLICATIONS

International Search Report for PCT/JP2017/041777, dated Jan. 30, 2018.

Office Action dated Sep. 3, 2021 from the China National Intellectual Property Administration in CN Application No. 201780096614.6.

Communication dated Jan. 27, 2022 from the State Intellectual Property Office of P.R. of China in Application No. 201780096614.6.

Communication dated May 18, 2022, issued in Chinese Application No. 201780096614.6.

* cited by examiner

ELECTROMAGNETIC SWITCH DEVICE FOR STARTER

CROSS REFERENCE TO RELATED APPLICATIONS

This application is a National Stage of International Application No. PCT/JP2017/041777 filed Nov. 21, 2017.

TECHNICAL FIELD

The present invention relates to an electromagnetic switch device for a starter, which is used for a starter which starts an engine which is mounted, for example, in an automobile.

BACKGROUND ART

In a conventional technology, an electromagnetic switch device for a starter, which generates an ignition magnetic force, by which a plunger is aspirated, in such a way that a plurality of coils is wound around a bobbin so as to be coaxially overlaid and wound, is known (for example, refer to Patent Document 1).

Moreover, an electromagnetic switch device for a starter, which generates an ignition magnetic force, by which a plunger is aspirated, in such a way that a plurality of coils is wound around a plurality of bobbins, and the coils and the bobbins are coaxially arranged, is known (for example, refer to Patent Document 2).

CONVENTIONAL ART DOCUMENT

Patent Document

Patent Document 1: Japanese Laid-Open Patent Publication No. 2002-313205

Patent Document 2: Japanese Laid-Open Patent Publication No. 2001-35336

SUMMARY OF THE INVENTION

Problems to be Solved by the Invention

However, coils, of which wire diameters are different from each other, are overlapped and wound around a bobbin, whereby a winding fluctuation is caused and extension lengths of the coils are varied. There have been problems in that the extension lengths of the coils are varied, whereby resistances of the coils are also varied, and an electric current, which is required in order to aspirate a plunger, is not stabilized, and capabilities are varied in accordance with individuals.

Moreover, the coils, of which wire diameters are different from each other, are wound around different bobbins, whereby although a winding fluctuation can be lost, there have been problems in that the number of components is increased and a manufacture cost is enhanced.

The present invention has been made to solve the above-described problems, and an object of the invention is to supply an electromagnetic switch device for a starter, by which a winding fluctuation of a plurality of coils, of which wire diameters are different from each other, is prevented, which can be down sized and can be produced with a low cost.

Means for Solving Problems

An electromagnetic switch device for a starter according to Embodiment 1 of the present invention includes a bobbin at which winding portions are separated by using flange portions, which include notch portions by which coils are led out, and separation walls, which include the notch portions by which the coils are led out; and the coils, of which number is greater than or equal to at least two, which respectively have a different wire diameter, are wound around winding portions which are separated.

Effects of the Invention

According to an electromagnetic switch device for a starter, a bobbin, at which winding portions are separated by using flange portions, which include notch portions by which the coils are led out, and separation walls by which the coils are led out, is provided, and the coils, of which number is greater than or equal to at least two, which respectively have a different wire diameter, are wound around the winding portions which are separated, whereby a winding fluctuation of the coils is prevented, and an effect, in which the electromagnetic switch device for a starter can be downsized and can be produced with a low cost, is obtained.

MODE FOR CARRYING OUT THE INVENTION

Embodiment 1

Figure 1:
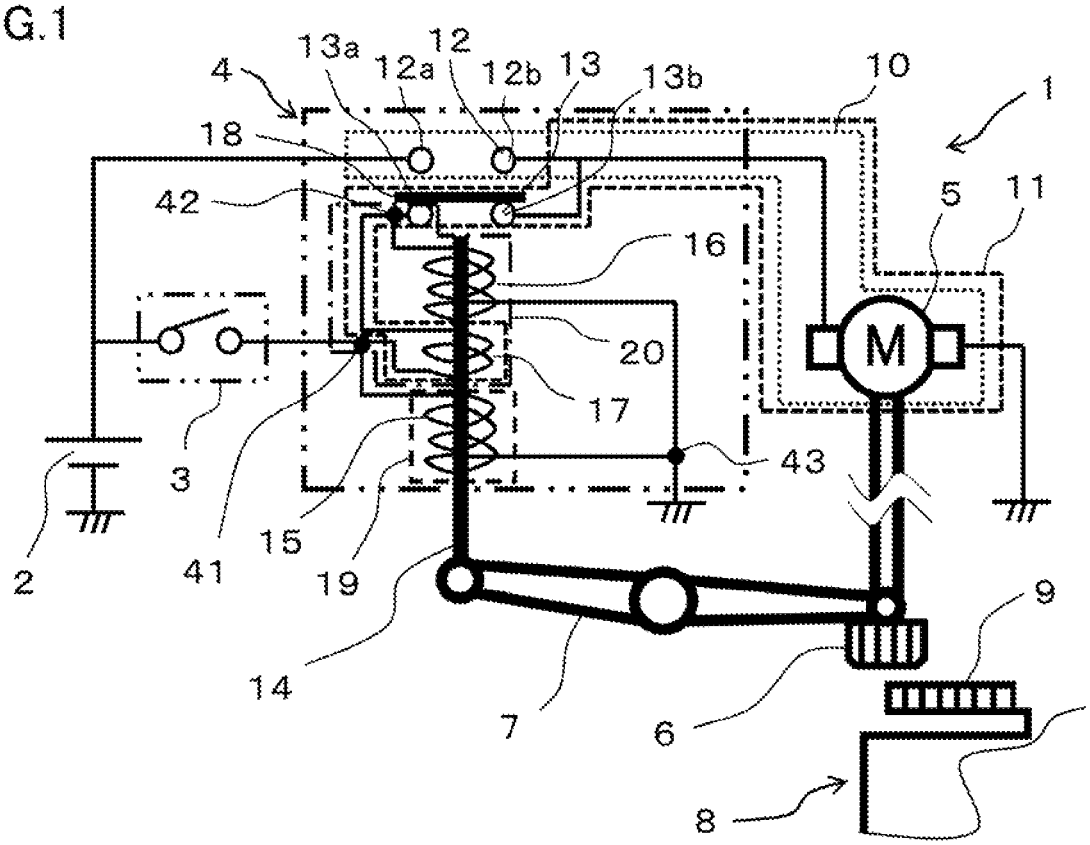
FIG. 1 is a circuit diagram which indicates a starter in which an electromagnetic switch device for a starter according to Embodiment 1 of the present invention is used.

FIG. 1 is a diagram which indicates a starter according to Embodiment 1 of the present invention. A starter 1 according to Embodiment 1 of the present invention includes an auxiliary relay 3 which is electrically connected to a battery 2; an electromagnetic switch device 4 for a starter, which is electrically connected to the battery 2 and the auxiliary relay 3; a motor 5 to which an electric current is supplied from the electromagnetic switch device 4 for a starter; a pinion 6 which is rotated in accordance with a driving operation of the motor 5; and a lever 7 which displaces the pinion 6 in such a way that the lever 7 is displaced. The pinion 6 is displaced between a separated position, which is separated with a predetermined distance from a ring gear 9 of an engine 8, and a contact position at which the pinion 6 is contacted to the ring gear 9. Moreover, the pinion 6 is displaced between the contact position and an engagement position at which the pinion 6 is engaged to the ring gear 9.

The pinion 6 is linked to the lever 7. The pinion 6 is displaced, in such a way that the lever 7 is displaced, between the separated position and the contact position, and moreover, the pinion 6 is also displaced between the contact position and the engagement position.

The auxiliary relay 3 switches an operation of the electromagnetic switch device 4 for a starter. The auxiliary relay 3 is closed (turned on) in accordance with a starting signal. The auxiliary relay 3 is closed, whereby an electric current is supplied from the battery 2, via the auxiliary relay 3, to the electromagnetic switch device 4 for a starter. On the other hand, the auxiliary relay 3 is opened (turned off), whereby it is stopped that an electric current is supplied, via the auxiliary relay 3, to the electromagnetic switch device 4 for a starter.

The electromagnetic switch device 4 for a starter displaces the pinion 6 via the lever 7, and moreover, the electromagnetic switch device 4 for a starter switches an electric circuit, by which an electric current is flowed to the motor 5, between a main electric circuit 10 and a starting electric circuit 11.

The motor 5 generates a rotational force, by which the ring gear 9 of the engine 8 is rotated via the pinion 6, by using an electric current which is supplied from the battery 2.

When the motor 5 is normally operated, an electric current is flowed, by using the main electric circuit 10, from the battery 2 to the motor 5. The main electric circuit 10 includes main electric contacts 12, which are composed of a pair of contacts, in a state where the main electric circuit 10 is opened or closed in such a way that the pair of contacts are electrically contacted or not contacted to each other. The main electric contacts 12 are opened when the motor 5 and the starter 1 are not operated. In this example, one contact, in the pare of contacts which compose the main electric contacts 12, is set as a main electric contact 12*a* at an upstream side, and the other contact, which composes the main electric contacts 12, is set as a main electric contact 12*b* at a downstream side. The main electric contact 12*a* at an upstream side is arranged at an upstream side with respect to the main electric contact 12*b* at a downstream side. The main electric contact 12*a* at an upstream side and the main electric contact 12*b* at a downstream side may be collectively called as a pair of the main electric contacts 12. In this case, the upstream side indicates a portion which is near to the battery 2 in the main electric circuit 10. In the following explanations, the upstream side similarly indicates the portion which is near to the battery 2 in the main electric circuit 10.

When the motor 5 is started and operated, an electric circuit is flowed, by using the starting electric circuit 11, from the battery 2 to the motor 5 The starting electric circuit 11 includes starting electric contacts 13, which are composed of a pair of contacts, in a state where the starting electric circuit 11 is opened or closed in such a way that the pair of contacts are electrically contacted or not contacted to each other. The starting electric contact 13 is closed when the starter 1 is not operated, and when the motor 5 is started and operated. In this example, one contact, in the pare of contacts which compose the starting electric contacts 13, is set as a starting electric contact 13*a* at an upstream side, and the other contact, which composes the electric contacts 13, is set as a starting electric contact 13*b* at a downstream side. The starting electric contact 13*a* at an upstream side is arranged at an upstream side with respect to the starting electric contact 13*b* at a downstream side. The starting electric contact 13*a* and the starting electric contact 13*b* may be collectively called as a pair of the starting electric contacts 13.

Moreover, the electromagnetic switch device 4 for a starter includes a movable iron core 14 which displaces the lever 7 in such a way that the movable iron core 14 is displaced, and the movable iron core 14 displaces the pinion 6; a main aspiration holding coil 15 which is provided around the movable iron core 14; a sub-aspiration holding coil 16 which is coaxially provided, around the movable iron core 14, with respect to the main aspiration holding coil 15; a resistance coil 17 which is branched at an upstream position with respect to the main aspiration holding coil 15 so as to be provided, and is electrically connected to the starting electric contact 13*a* at an upstream side, which is one contact which composes the starting electric contacts 13, and is coaxially provided with respect to the main aspiration holding coil 15; and a movable contact 18 which is displaced while the movable iron core 14 is displaced. The movable iron core 14 is joined to the lever 7 so as to be linked. When the auxiliary relay 3 is opened, the movable contact 18 closes the pair of starting electric contacts 13 by using an energizing force of a spring which is not illustrated.

An electric current is flowed to the main aspiration holding coil 15, whereby an initiation magnetic force, by which the movable iron core 14 is displaced, is generated at the main aspiration holding coil 15. An electric current is flowed to the sub-aspiration holding coil 16, whereby an initiation magnetic force is generated at the sub-aspiration holding coil 16.

A main aspiration holding circuit 19 is composed of the main aspiration holding coil 15. The sub-aspiration holding circuit 20 is composed of the resistance coil 17, the starting electric contact 13*a* at an upstream side, and the sub-aspiration holding coil 16. The resistance coil 17 is also included in the starting electric circuit 11.

An electric circuit of the starter 1 is composed of the main electric circuit 10, the starting electric circuit 11, the main aspiration holding circuit 19, and a sub-aspiration holding circuit 20.

An electric circuit of the electromagnetic switch device 4 for a starter is composed of components in which the auxiliary relay 3 and the motor 5, in the electric circuit of the starter 1, are excluded. In addition, it is suitable that the auxiliary relay 3 is included in the electric circuit of the electromagnetic switch device 4 for a starter.

Figure 2:
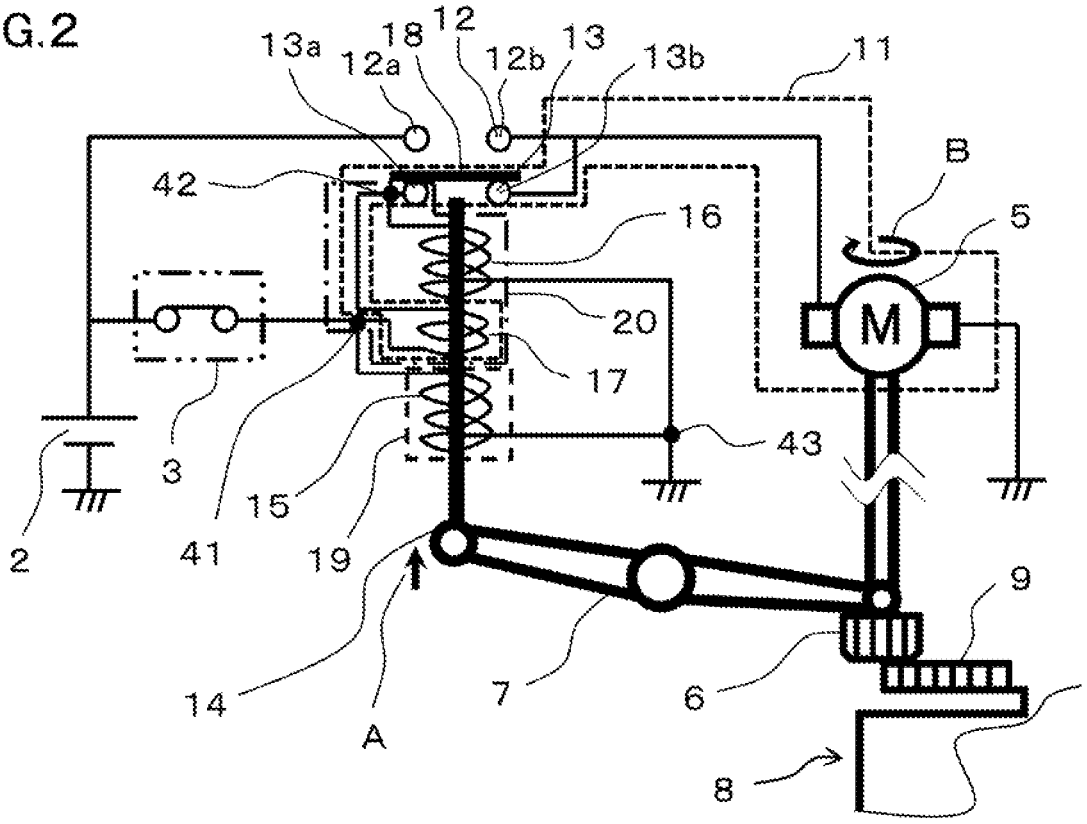
FIG. 2 is a circuit diagram by which a first operation stage at the starter, which is indicated in FIG. 1, is explained.
Figure 3:
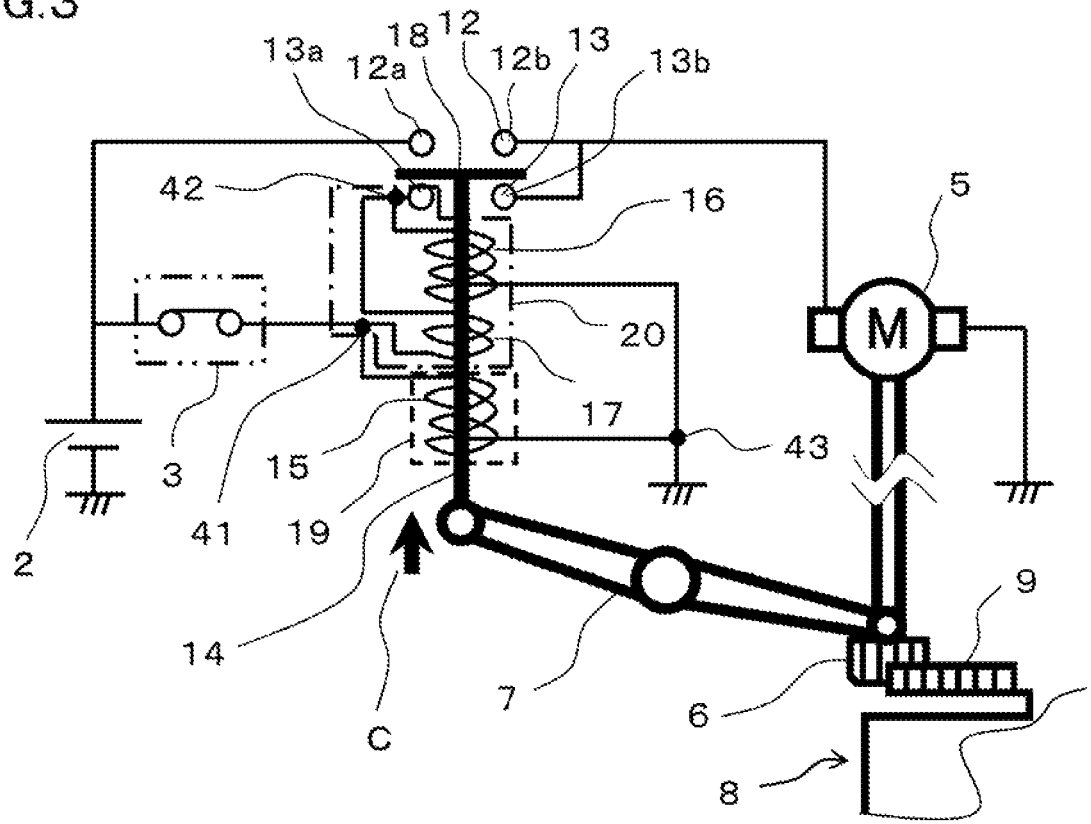
FIG. 3 is a circuit diagram by which a second operation stage at the starter, which is indicated in FIG. 1, is explained.
Figure 4:
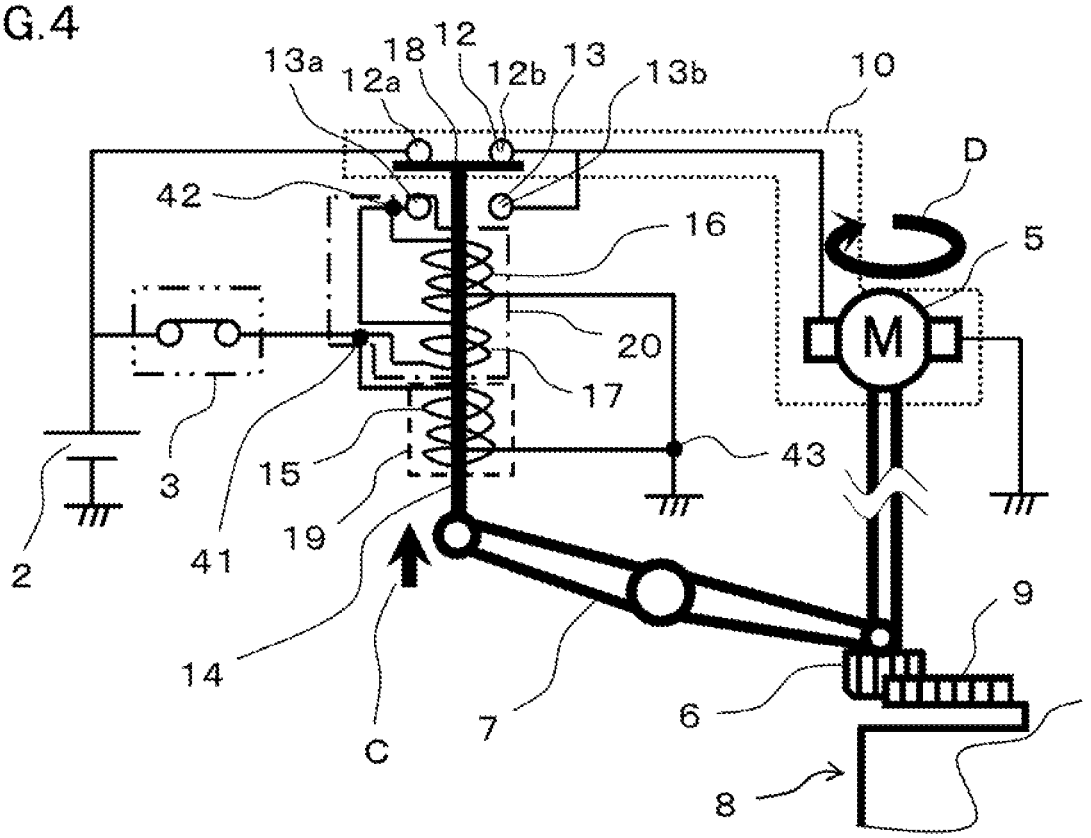
FIG. 4 is a circuit diagram by which a third operation stage at the starter, which is indicated in FIG. 1, is explained.

In the following descriptions, an operation of the starter 1 will be explained. Firstly, a first operation stage, which is an operation in which the pinion 6 is displaced from a separated position to a contact position, and the pinion 6 is rotated to a position at which the other tooth is inserted between one tooth and one tooth and between the pinion 6 and the ring gear 9, will be explained. FIG. 2 is a diagram by which the first operation stage at the starter 1, which is indicated in FIG. 1, is explained. In addition, in FIG. 2, although a part of symbols, which are indicated in FIG. 1, is omitted, a configuration of the starter 1 in FIG. 2 is similar to a configuration of the starter 1 in FIG. 1. A configuration of the starter 1 in each of FIG. 3 and FIG. 4 is similar to the configuration of the starter 1 in FIG. 1.

The auxiliary relay 3 is closed in accordance with a start requirement. Thereby, an electric current is supplied from the battery 2 to the main aspiration holding circuit 19 and the sub-aspiration holding circuit 20. Moreover, the pair of starting electric contacts 13 is closed by using the movable contact 18, so that an electric current is supplied from the battery 2, via the starting electric circuit 11, to the motor 5.

Moreover, the movable contact 18 is pressed to the pair of starting electric contacts 13 by using an energizing force of a spring (which is not illustrated) so as to be closed, so that an electric current is supplied from the battery 2, via the starting electric circuit 11, to the motor 5.

An initiation magnetic force is generated at the main aspiration holding coil 15 in accordance with an electric current which is flowed to the main aspiration holding circuit 19. Thereby, a starting aspiration force "A", by which the movable iron core 14 is slowly moved to the movable contact 18, is generated.

The sub-aspiration holding coil 16 of the sub-aspiration holding circuit 20 is connected in parallel with respect to the motor 5 of the starting electric circuit 11, and a resistance value of the sub-aspiration holding coil 16 is very large in comparison with a resistance value of the motor 5, so that most of an electric current, which is passed through the starting electric contact 13*a* at an upstream side, is flowed to the motor 5. Thereby, a starting rotational force "B", by which the pinion 6 is slowly rotated, is generated. The starting rotational force "B" is regulated in accordance with a resistance value of the resistance coil 17.

A part of an electric current, which is passed through the starting electric contact 13*a* at an upstream side, is flowed to the sub-aspiration holding coil 16, and a minute initiation magnetic force is generated at the sub-aspiration holding coil 16. However, the initiation magnetic force, which is generated, is minute with respect to an initiation magnetic force which is generated at the main aspiration holding coil 15, so that the initiation magnetic force, which is generated at the sub-aspiration holding coil 16, does not nearly contribute to the starting aspiration force "A".

The starting aspiration force "A" slowly shifts the pinion 6, via the lever 7 which is joined to the movable iron core 14, toward an end surface of the ring gear 9, from a separated position to a contact position. In this case, the initiation magnetic force, which is generated at the sub-aspiration holding coil 16, does not nearly contribute to the starting aspiration force "A", so that a collision force, which is generated between the pinion 6 and the ring gear 9, is reduced in comparison with a case in which an initiation magnetic force, which is generated at the sub-aspiration holding coil 16, contributes to the starting aspiration force "A". Thereby, an abrasion of the ring gear 9 is reduced.

After the pinion 6 is smashed to the ring gear 9, although the pinion 6 cannot be displaced from the contact position to the engagement position in a state where an end surface of the pinion 6 is contacted to an end surface of the ring gear 9, the pinion 6 is slowly engaged to the ring gear 9 in accordance with the starting rotational force "B".

In the following descriptions, a second operation stage, which is an operation in which the pinion 6 is displaced from a contact position to an engagement position, after the first operation stage is performed, will be explained. FIG. 3 is a diagram by which the second operation stage at the starter 1, which is indicated in FIG. 1, is explained. After the pinion 6 is engaged to the ring gear 9 at the first operation stage, and when the movable iron core 14, which is joined to lever 7, is more shifted and the movable iron core 14 reaches the movable contact 18, the movable contact 18 is shifted in a direction where the movable contact 18 is separated from the pair of starting electric contacts 13 while the movable contact 18 resists to an energizing force of a spring which is not illustrated, whereby the pair of starting electric contacts 13 is opened. Thereby, an electric current, which is flowed to the starting electric circuit 11, is interrupted, and the starting rotational force "B" of the motor 5 is lost.

When the starting electric contacts 13 are opened, an electric current, which is flowed through the sub-aspiration holding coil 16, is equal to an electric current, which is flowed through the resistance coil 17, and a value of the electric current, which is flowed through the sub-aspiration holding coil 16, is smaller than an electric current which is flowed through the resistance coil 17 before the starting electric contacts 13 are opened. However, the value of the electric current, which is flowed through the sub-aspiration holding coil 16, is larger than a value of an electric current which is flowed through the sub-aspiration holding coil 16 before the starting electric contacts 13 are opened. Thereby, an initiation magnetic force of the sub-aspiration holding coil 16 is enhanced in comparison with an initiation magnetic force in a case of the first operation stage. On the other hand, an electric current, which is flowed through the main aspiration holding coil 15, is not nearly changed, and an initiation magnetic force, which is similar to an initiation magnetic force in a case of the first operation stage, is generated. Therefore, the initiation magnetic force of the sub-aspiration holding coil 16 greatly contributes to an aspiration holding force "C" by which an operation in a case of the second operation stage is smoothly performed.

As described above, the electric current, which is flowed to the resistance coil 17, is greatly reduced in comparison with the electric current in a case of the first stage. As a result, an amount of generated heat, which is generated at the resistance coil 17, is suppressed.

In the following descriptions, a third operation stage will be explained in a state where the main electric contacts 12 are closed after the second operation stage is performed, whereby a main rotational force "D" is generated at the motor 5, and a condition, in which the main rotational force "D" is generated, is held. FIG. 4 is a diagram by which the third operation stage at the starter 1, which is indicated in FIG. 1, is explained. In the second operation stage, after the movable contact 18 is shifted in a direction where the movable contact 18 is separated from the starting electric contacts 13, and when the movable contact 18 is shifted in a direction where the movable contact 18 is more separated from the starting electric contacts 13 by using an aspiration holding force "C", the movable contact 18 is struck to the pair of main electric contacts 12, whereby the pair of main electric contacts 12 is closed. Thereby, the main electric circuit 10 is closed, and an electric current is flowed from the battery 2 to the motor 5. As a result of this, the main rotational force "D", by which the engine 8 is driven, is generated at the motor 5. By the above-described operations, when the engine 8 is started, an operation of the starter 1 is not required, and the auxiliary relay 3 is opened, whereby the starter 1 is stopped.

As described above, the electromagnetic switch device 4 for a starter according to Embodiment 1 of the present invention includes the pair of main electric contacts 12 which composes the main electric circuit 10 in a state where the main electric circuit 10 is opened or closed in such a way that the main electric contacts 12 are electrically connected or not connected to each other; the pair of starting electric contacts 13 which composes the starting electric circuit 11 in a state where the starting electric circuit 11 is opened or closed in such a way that the starting electric contacts 13 are electrically connected or not connected to each other; the movable iron core 14 which displaces the pinion 6 of the starter 1 between a separated position, at which the pinion 6 is separated from the ring gear 9 of the engine 8, and a contact position, at which the pinion 6 is contacted to the ring gear 9, and between the contact position and an engaged position at which the pinion 6 is engaged to the ring gear 9; the main aspiration holding coil 15 which is provided around the movable iron core 14 so as to generate an initiation magnetic force; the resistance coil 17 which is branched so as to be provided at an upstream side with respect to the main aspiration holding coil 15, and is electrically connected to the starting electric contact 13*a* at an upstream side; and the sub-aspiration holding coil 16 which is electrically connected to the starting electric contact 13*a* at an upstream side, and is coaxially provided, around the movable iron core 14, with respect to the main aspiration holding coil 15 so as to generate an initiation force; in which the movable iron core 14 generates, in accordance with a starting signal, by using an initiation magnetic force of the main aspiration holding coil 15, the starting aspiration force "A" by which the pinion 6 is displaced from the separated position to the contact position; and the starting rotational force "B" is generated by using an electric current which is flowed through the resistance coil 17, and after the pinion 6 is displaced from the separated position to the contact position, the starting electric contacts 13 are electrically set in a non-contact state, whereby an electric current, which is flowed to the motor 5, is interrupted so as to lose the starting rotational force "B"; and the aspiration holding force "C", by which the pinion 6 is displaced from the separated position to the engagement position, is generated by using the initiation magnetic force of the main aspiration holding coil 15 and the initiation magnetic force of the sub-aspiration holding coil 16, and after the pinion 6 is displaced from the contact position to the engagement position, the main electric contacts 12 are electrically set in a connection state, whereby it is restarted that an electric current is passed through the motor 5, and the main rotational force "D" of the motor 5 is generated; and the aspiration holding force "C", by which the movable iron core 14 holds the pinion 6 at the engagement position, is generated by using the initiation magnetic force of the main aspiration holding coil 15 and the initiation magnetic force of the sub-aspiration holding coil 16.

As described above, in the electromagnetic switch device 4 for a starter according to Embodiment 1 of the present invention, the starting aspiration force "A", which is used when the pinion 6, which is operated at the first operation stage of an engagement operation, is displaced from the separated position to the contact position, is reduced, whereby a collision force of the pinion 6 and the ring gear 9 is reduced, whereby an abrasion of the ring gear 9 can be reduced.

Moreover, the aspiration holding force "C", which is used when the pinion 6, which is operated at the second operation stage, is displaced from the contact position to the engagement position, can be enhanced, so that the operation of the pinion 6 in the second operation stage can be smoothly performed. Moreover, the pinion 6 can be displaced from the contact position to the engagement position, in a state where the starting rotational force "B" and the main rotational force "D" are lost, so that the pinion 6 can be displaced from the contact position to the engagement position, in a state where friction at an engagement tooth surface is lost, and thereby, the operation of the pinion 6 at the second operation stage can be smoothly performed.

Moreover, the aspiration holding force "C", which is used after the pinion 6, which is operated at the third operation stage, is displaced from the contact position to the engagement position, can be enhanced, so that the pinion 6 can be certainly held at the engagement position.

In the following descriptions, a bobbin, which composes the electromagnetic switch device 4 for a starter, will be explained.

Figure 5:
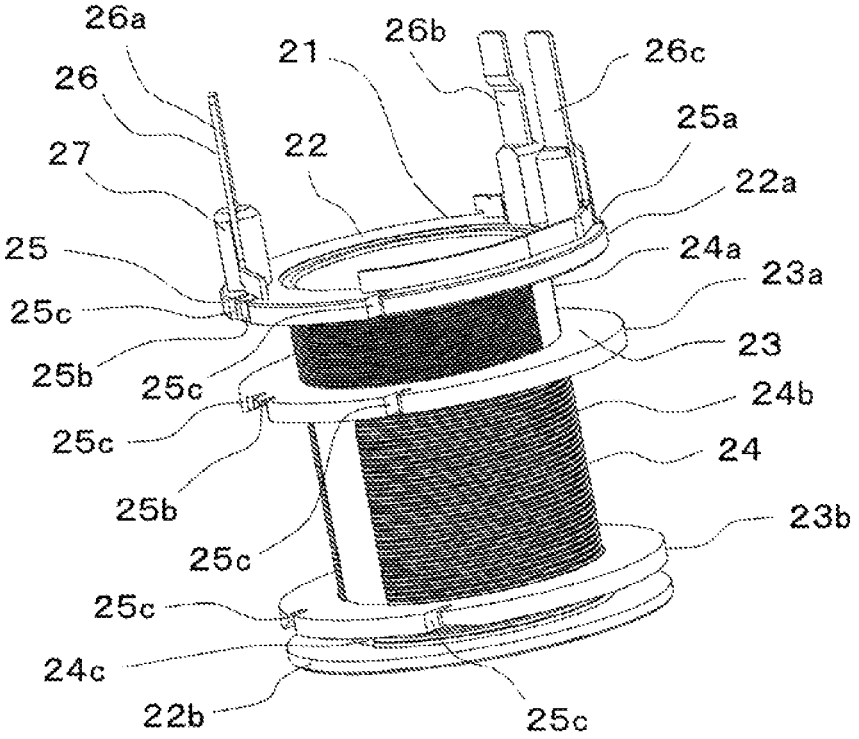
FIG. 5 is a projection view which indicates a bobbin in the electromagnetic switch device for a starter according to Embodiment 1 of the present invention.

FIG. 5 is a projection view which indicates the bobbin in the electromagnetic switch device 4 for a starter according to Embodiment 1 of the present invention. A bobbin 21 includes flange portions 22 which are composed of a first flange portion 22*a* and a second flange portion 22*b*, which are respectively provided at both end portions of the bobbin 21; winding portions 24 which are composed of a first winding portion 24*a*, a second winding portion 24*b*, and a third winding portion 24*c*, around which the main aspiration holding coil 15, the sub-aspiration holding coil 16, and the resistance coil 17 are wound between the flange portions 22 and the winding portions 24; and separation walls 23 which are composed of a first separation wall 23*a* and a second separation wall 23*b*, which are provided in such a way that the winding portions 24 are separated.

At the winding portions 24 which are separated, a winding groove, which is corresponding to a wire diameter of each of the above-described coils, is included, and each of the above-described coils can be wound around each of the winding portions in a state where a winding fluctuation is not caused.

The sub-aspiration holding coil 16 is wound around the first winding portion 24*a*, and the main aspiration holding coil 15 is wound around the second winding portion 24*b*, and the resistance coil 17 is wound around the third winding portion 24*c*. At first flange portion 22*a*, terminals 26, which are composed of a first terminal 26*a*, a second terminal 26*b*, and a third terminal 26*c*, are held by using terminal attaching portions 27.

At the flange portions 22 and separation walls 23, notch portions 25 are provided in order to lead in or lead out each of the above-described coils from the outside to the winding portions 24. The notch portions 25 are composed of a first notch portion 25*a*, second notch portions 25*b*, and third notch portions 25*c*, which are described in the following descriptions, and the notch portions 25 are collectively called as notch portions.

At the first flange portion 22*a*, the first notch portion 25*a*, which is used for leading in or leading out the sub-aspiration holding coil 16 to the first winding portion 24*a*, and the second notch portions 25*b*, which are used for leading in or leading out the main aspiration holding coil 15 to the second winding portion 24*b*, and the third notch portions 25*c*, which are used for leading in or leading out the resistance coil 17 to the third winding portion 24*c*, are provided.

At the first separation wall 23*a*, the second notch portions 25*b*, which are used for leading in or leading out the main aspiration holding coil 15 to the second winding portion 24*b*, and the third notch portions 25*c*, which are used for leading in or leading out the resistance coil 17 to the third winding portion 24*c*, are provided.

At the second separation wall 23*b*, the third notch portions 25*c*, which are used for leading in or leading out the resistance coil 17 to the third winding portion 24*c*, are provided.

The terminals 26 are electrically connected to a lead wire 28 of the main aspiration holding coil 15, a lead wire 29 of the sub-aspiration holding coil 16, and a lead wire 30 of the resistance coil 17, which are described in the following descriptions, whereby an electric circuit is formed.

At the first flange portion 22*a*, the terminal attaching portions 27, by which the terminals 26 are attached, are provided, and the terminals 26 are pressed and inserted to the terminal attaching portions 27.

Figure 6:
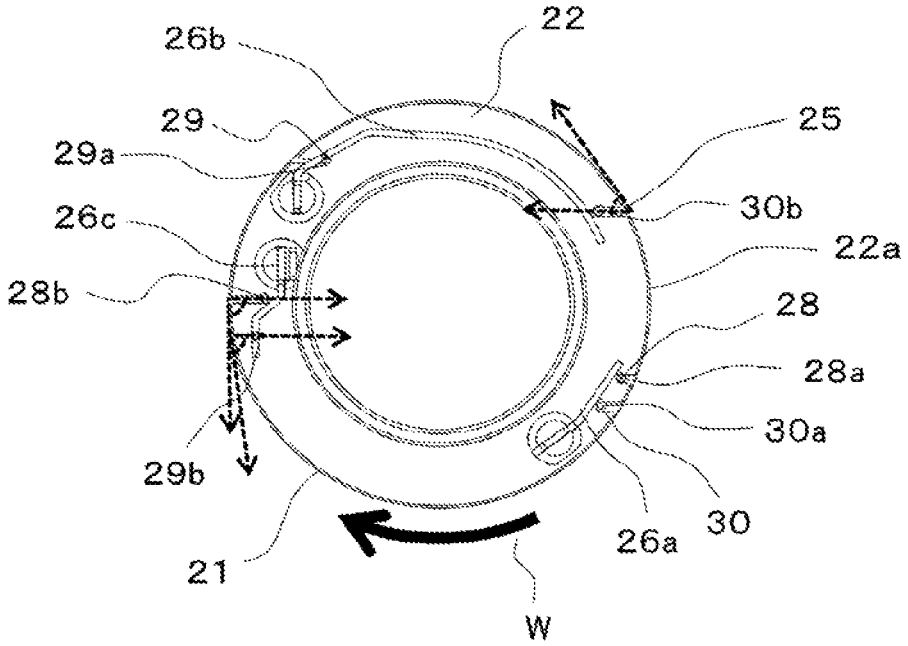
FIG. 6 is a front view which indicates the bobbin in the electromagnetic switch device for a starter according to Embodiment 1 of the present invention.

FIG. 6 is a front view which indicates the bobbin in the electromagnetic switch device for a starter according to Embodiment 1 of the present invention. The bobbin 21 is produced by using a resin molding method. In order to easily divide a form of the notch portions 25, all of the notch portions 25 are arranged in parallel.

At the first terminal 26*a*, a winding start portion 28*a* of the lead wire 28 of the main aspiration holding coil 15 and a winding start portion 30*a* of the lead wire 30 of the resistance coil 17 are electrically connected by using a resistor welding method or the like, whereby a wire connecting portion 41, which is indicated in FIG. 1 through FIG. 4, is formed.

At the second terminal 26*b*, a winding start portion 29*a* of the lead wire 29 of the sub-aspiration holding coil 16 and a winding end portion 30*b* of the lead wire 30 of the resistance coil 17 are electrically connected by using a resistor welding method or the like, whereby a wire connecting portion 42, which is indicated in FIG. 1 through FIG. 4, is formed.

At the third terminal 26*c*, a winding end portion 28*b* of the lead wire 28 of the main aspiration holding coil 15 and a winding end portion 29*b* of the lead wire 29 of the sub-aspiration holding coil 16 are electrically connected by using a resistor welding method or the like, whereby a wire connecting portion 43, which is indicated in FIG. 1 through FIG. 4, is formed.

As indicated by using dashed line arrows in FIG. 6, at intersection points of the notch portions 25 and the most outer diameter of the flange portions 22, angles, which are formed between the notch portions 25, by which the winding end portion 28*b* of the lead wire 28 of the main aspiration holding coil 15 is led out, and tangent lines which are contacted to the most outer diameters of the flange portions 22, are smaller than a 90 degree, whereby it is suppressed that the winding end portion 28*b* of the lead wire 28 of the main aspiration holding coil 15 is returned, in a reverse direction with respect a winding direction, in accordance with a spring back which is caused by a winding operation.

In a similar way, in a case of the winding end portion 29*b* of the lead wire 29 of the sub-aspiration holding coil 16 and the winding end portion 30*b* of the lead wire 30 of the resistance coil 17, at intersection points of the notch portions 25 and the most outer diameters of the flange portions 22, winding end positions of the coils are determined in such a way that angles, which are formed between the notch portions 25 and the tangent lines which are contacted to the most outer diameter of the flange portions 22, are smaller than a 90 degree.

In this similar way, at the winding end portions of the lead wires of the coils which are led out from the notch portions 25, as indicated by using the dashed line arrows in FIG. 6, angles, which are formed by vectors, which are parallel to the notch portions 25 and tend to a center of the bobbin, and vectors, which tend in a winding start direction at tangent lines, at the most outer diameters of the flange portions 22, which are contacted to the cross points of the notch portions 25 and the most outer diameters of the flange portions 22, are smaller than a 90 degree.

Figure 7:
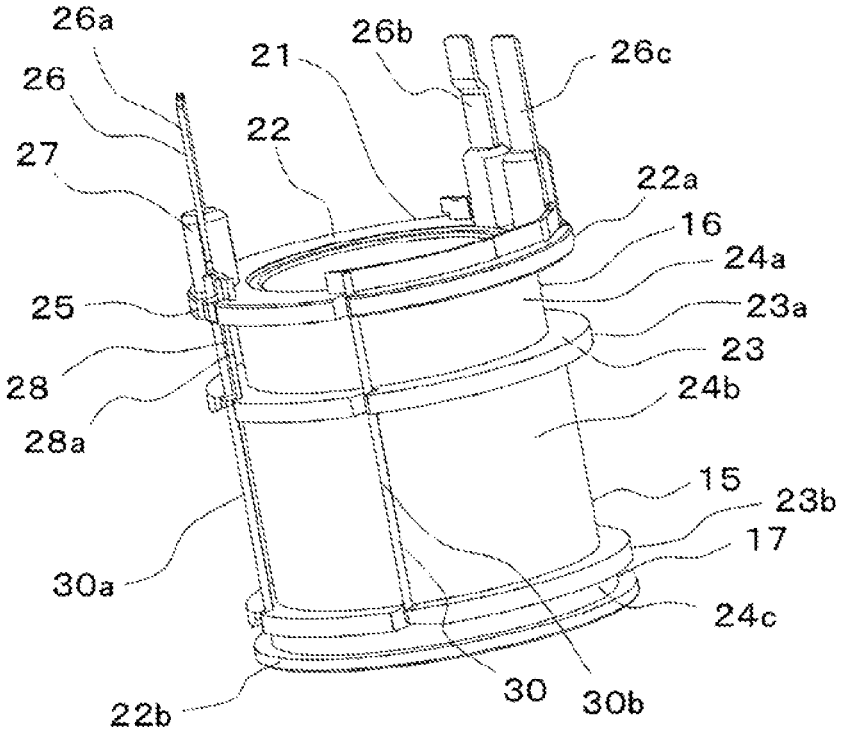
FIG. 7 is a projection view which indicates the bobbin around which coils are wound in the electromagnetic switch device for a starter according to Embodiment 1 of the present invention.

FIG. 7 is a projection view which indicates the bobbin after the coils are wound. In addition, in FIG. 7, although parts of the symbols, which are indicated in FIG. 5, are omitted, a configuration of the parts is identical to a configuration of the parts which are indicated in FIG. 5.

The sub-aspiration holding coil 16 is wound in such a way that an outer diameter of the sub-aspiration holding coil 16, which is wound around the first winding portion 24*a*, is smaller than the most outer diameter of the main aspiration holding coil 15 which is wound around the second winding portion 24*b*.

The main aspiration holding coil 15 is wound in such a way that an outer diameter of the main aspiration holding coil 15, which is wound around the second winding portion 24*b*, is smaller than the most outer diameter of the resistance coil 17 which is wound around the third notch portions 25*c*.

In other words, at the most outer diameters of the coils which are respectively wound around the winding portions which are separated, each of the most outer diameters is increased in accordance with positions which are sequentially near to the flange portions at which the notch portions are formed.

The lead wire 28 of the main aspiration holding coil 15, which is wound around the second winding portion 24*b*, crosses the outside of the most outer diameter of the sub-aspiration holding coil 16, which is wound around the first winding portion 24*a*, and the lead wire 28 is led out to the notch portion 25 of the first flange portion 22*a*.

The lead wire 30 of the resistance coil 17, which is wound around the third winding portion 24*c*, crosses the outside of the most outer diameter of the main aspiration holding coil 15, which is wound around the second winding portion 24*b*, and the lead wire 30 is led out to the notch portion 25 of the first flange portion 22*a*.

In other words, the lead wires of the coils, which are wound around the winding portions which are separated, cross the most outer diameters of the above-described coils, of which wire diameters are different from each other, which are wound around the winding portions which are adjacent to the flange portion sides at which the notch portions are formed, and the lead wires are led out toward the flange portions at which notch portions are formed.

In the electromagnetic switch device for a starter according to Embodiment 1, the bobbin, at which the winding portions are separated by using the flange portions, which include the notch portions by which the coils are led out, and the separation walls, which include the notch portions by which the coils are led out, is provided, and the coils, of which number is greater than or equal to at least two, which respectively have a different wire diameter, are wound around the winding portions which are separated, whereby a winding fluctuation of the coils can be prevented, and the electromagnetic switch device for a starter can be downsized and can be produced with a low cost.

In Embodiment 1, although the electromagnetic switch device for a starter is explained in reference to a configuration in which three kinds of the coils, of which wire diameters are different from each other, are wound around the winding portions which are separated to three parts, even when the electromagnetic switch device for a starter is designed in such a way that the number of kinds of the coils is greater than or equal to two, and the winding portions, which are separated in a state where the number of the winding portions is equal to the number of kinds of the coils, are formed, a similar effect is obtained.

The electromagnetic switch device for a starter of the present invention is not limited to the above-described embodiment, and the embodiment can be suitably modified in the scope of the present invention.

DESCRIPTION OF THE SYMBOLS

"4" is an electromagnetic switch device for a starter; "15," a main aspiration holding coil; "16," a sub-aspiration holding coil; "17," a resistance coil; "21," a bobbin; "22," flange portions; "22*a*," a first flange portion; "22*b*," a second flange portion; "23," separation walls; "23*a*," a first separation wall; "23*b*," a second separation wall; "24," winding portions; "24*a*," a first winding portion; "24*b*," a second winding portion; "24*c*," a third winding portion; "25," notch portions; "25*a*," a first notch portion; "25*b*," second notch portions; "25*c*," third notch portion; "26," terminals; "28," a lead wire of the main aspiration holding coil; "28*a*," a winding start portion; "28*b*," a winding end portion; "29," a lead wire of the sub-aspiration holding coil; "29*a*," a winding start portion; "29*b*," a winding end portion; "30," a lead wire of the resistance coil; "30*a*," a winding start portion; "30*b*," a winding end portion.

What is claimed is:

1. An electromagnetic switch device provided at electric circuits of a starter by which an engine is started, comprising:

coils which generate initiation magnetic forces by which contacts of the electric circuits occur; wherein the coils respectively have a different wire diameter and are wound around at least three winding portions of a bobbin which are separated from each other by at least two separation walls;

the coils comprises a main-aspiration holding coil provided around an iron core and configured to generate an initiation magnetic force to move the iron core, a sub-aspiration holding coil connected to a starting electric contact and provided around the iron core, and a resistance coil provided between the starting electric contact and an auxiliary relay that is connected to a battery;

the bobbin includes flange portions which are positioned at two opposing ends of the bobbin; and the at least two separation walls and at least one of the flange portions include notch portions by which the coils are led out.

2. The electromagnetic switch device of claim 1, wherein all the notch portions, which are provided at the flange portions and the at least one of the separation walls, are arranged in parallel.

3. The electromagnetic switch device of claim 1, wherein lead wires of the coils, which are led out from the notch portions, are electrically connected to terminals which are attached to terminal attaching portions which are provided at the flange portions.

4. The electromagnetic switch device of claim 1, wherein, at winding end portions of lead wires of the coils which are led from the notch portions, angles of the notch portions that extend inwardly toward an inside of the bobbin, with respect to tangent lines to a most outer circumference of the flange portions are smaller than 90 degrees.

5. The electromagnetic switch device of claim 1, wherein the flange portions include a first flange portion and a second flange portion at the two opposing ends of the bobbin, and diameters of the at least three winding portions are different from each other, and increase in a direction from the first flange portion to the second flange portion.

6. The electromagnetic switch device of claim 5, wherein most outer diameters of the coils that are wound around the least three winding portions are different from each other, and increase in the direction from the first flange portion to the second flange portion.

7. The electromagnetic switch device of claim 1, wherein the at least three winding portions include a first winding portion around which the sub-aspiration holding coil is wound, a second winding portion around which the main-aspiration holding coil is wound, and a third winding portion around which the resistance coil is wound, and wherein the sub-aspiration holding coil is connected in parallel with a motor, and a resistance of the sub-aspiration holding coil is greater than a resistance of the motor so that an electric current which has passed through the starting electric contact, flows to the motor.

8. The electromagnetic switch device of claim 1, wherein the at least three winding portions include a first winding portion, a second winding portion, and a third winding portion, and wherein the second winding portion having the main-aspiration holding coil is positioned between the first winding portion having the sub-aspiration holding coil, and the third winding portion having the resistance coil.

* * * * *